US011834793B2

(12) United States Patent
Backfolk et al.

(10) Patent No.: US 11,834,793 B2
(45) Date of Patent: Dec. 5, 2023

(54) PROCESS FOR PRODUCTION OF FILM COMPRISING MICROFIBRILLATED CELLULOSE

(71) Applicant: Stora Enso OYJ, Helsinki (FI)

(72) Inventors: Kaj Backfolk, Villmanstrand (FI); Isto Heiskanen, Imatra (FI); Esa Saukkonen, Lappeenranta (FI); Jukka Kankkunen, Imatra (FI); Anna Nyberg Zetterlund, Hammarö (SE); Jan Lif, Hammarö (SE)

(73) Assignee: Stora Enso OYJ, Helsinki (FI)

( * ) Notice: Subject to any disclaimer, the term of this patent is extended or adjusted under 35 U.S.C. 154(b) by 389 days.

(21) Appl. No.: 16/966,527

(22) PCT Filed: Jan. 31, 2019

(86) PCT No.: PCT/IB2019/050768

§ 371 (c)(1),
(2) Date: Jul. 31, 2020

(87) PCT Pub. No.: WO2019/150291

PCT Pub. Date: Aug. 8, 2019

(65) Prior Publication Data

US 2021/0054570 A1 Feb. 25, 2021

(30) Foreign Application Priority Data

Feb. 2, 2018 (SE) ..... 1850123-9

(51) Int. Cl.

| | |
|---|---|
| ***D21H 23/28*** | (2006.01) |
| ***D21H 11/08*** | (2006.01) |
| ***D21H 23/48*** | (2006.01) |
| ***D21H 23/50*** | (2006.01) |
| ***D21H 23/52*** | (2006.01) |
| ***D21H 19/40*** | (2006.01) |
| ***D21H 19/66*** | (2006.01) |
| ***D21H 11/18*** | (2006.01) |

(52) U.S. Cl.
CPC ..... *D21H 23/28* (2013.01); *D21H 11/18* (2013.01); *D21H 19/40* (2013.01); *D21H 19/66* (2013.01); *D21H 23/48* (2013.01); *D21H 23/50* (2013.01); *D21H 23/52* (2013.01)

(58) Field of Classification Search
CPC ..... D21H 23/28; D21H 11/18; D21H 19/40; D21H 19/66; D21H 23/48; D21H 23/50; D21H 23/52; D21H 17/63; D21H 21/14; D21H 21/52; D21H 17/00; D21H 19/00
See application file for complete search history.

(56) References Cited

U.S. PATENT DOCUMENTS

| | | | | |
|---|---|---|---|---|
| 9,127,405 | B2 * | 9/2015 | Husband | D21B 1/30 |
| 10,100,467 | B2 * | 10/2018 | Gane | D21H 11/18 |
| 10,435,842 | B2 * | 10/2019 | Heiskanen | D21H 21/16 |
| 10,676,868 | B2 * | 6/2020 | Heiskanen | B29D 7/01 |
| 10,794,006 | B2 * | 10/2020 | Phipps | D01F 1/10 |
| 11,155,697 | B2 * | 10/2021 | Gane | D21H 17/675 |
| 11,155,698 | B2 * | 10/2021 | Heiskanen | B32B 5/02 |
| 11,161,948 | B2 * | 11/2021 | Backfolk | D21H 27/10 |
| 11,192,987 | B2 * | 12/2021 | Backfolk | D21H 17/68 |
| 11,193,241 | B2 * | 12/2021 | Hakansson | D21H 17/69 |
| 11,319,671 | B2 * | 5/2022 | Backfolk | D21H 21/52 |
| 11,377,791 | B2 * | 7/2022 | Husband | D21H 19/385 |
| 11,384,210 | B2 * | 7/2022 | Kritzinger | B29C 51/10 |
| 11,441,261 | B2 * | 9/2022 | Ward | C12N 9/54 |
| 11,572,659 | B2 * | 2/2023 | Phipps | D01D 1/02 |
| 2003/0152724 | A1 | 8/2003 | Swoboda et al. | |
| 2017/0335519 | A1 * | 11/2017 | Hakansson | C09C 1/021 |
| 2018/0245289 | A1 * | 8/2018 | Heiskanen | D21H 19/10 |
| 2018/0265597 | A1 | 9/2018 | Homma et al. | |
| 2019/0024318 | A1 * | 1/2019 | Backfolk | D21H 17/29 |
| 2020/0023409 | A1 * | 1/2020 | Axrup | C08J 5/18 |
| 2021/0054570 | A1 * | 2/2021 | Backfolk | D21H 23/52 |

FOREIGN PATENT DOCUMENTS

| | | | | |
|---|---|---|---|---|
| EP | 3350372 | B1 * | 1/2020 | C08J 5/18 |
| WO | 2014154937 | A1 | 10/2014 | |
| WO | 2017046749 | A1 | 3/2017 | |
| WO | 2017046751 | A1 | 3/2017 | |
| WO | 2017047768 | A1 | 3/2017 | |

(Continued)

OTHER PUBLICATIONS

Bown et al. in "A Review of the Influence of Pigments on Papermaking and Coating" The Fundamentals of Papermaking Materials, Trans. of the XIth Fund. Res. Symp. Cambridge, 1997, (C.F. Baker, ed.), pp. 83-137, FRC, Manchester, 2018. DOI: 10.15376/frc.1997.1.83. (Year: 1997).*

Fellers, C. Norman, B. Pappersteknik, Stockholm: Kungliga Tekniska Högskolan, 1998, vol. 3, p. 393-403, ISBN 91-7170-741-7; pp. 393-403.

Masafumi Arakawa, Introduction to Particle Size Measurement, Journal of the Society of Powder Technology, Japan, Jun. 10, 1980, vol. 17, No. 6, pp. 299-307.

(Continued)

*Primary Examiner* — Jose A Fortuna

(74) *Attorney, Agent, or Firm* — Greer, Burns & Crain, Ltd.

(57) ABSTRACT

The present invention relates to a process for manufacturing a film comprising high amounts of microfibrillated cellulose (MFC), having haptic properties. According to the present invention, a wet web comprising MFC is formed, followed by addition of particles having an average diameter of at least 1 μm to the wet web, followed by dewatering and/or drying. The wet web may be formed for example by wet laid or cast forming methods. The particles may be added to the wet web for example by cast coating or spraying.

12 Claims, No Drawings

(56) References Cited

FOREIGN PATENT DOCUMENTS

| | | | | |
|---|---|---|---|---|
| WO | WO-2017046751 | A1 * | 3/2017 | ..... D21H 11/18 |
| WO | 2017221137 | A1 | 12/2017 | |
| WO | WO-2019150291 | A1 * | 8/2019 | ..... D21H 11/18 |
| WO | WO-2019166929 | A1 * | 9/2019 | ..... D21H 11/18 |

OTHER PUBLICATIONS

Japanese Office Action from corresponding JP application No. 2020-535493, dated Dec. 21, 2022.

* cited by examiner

PROCESS FOR PRODUCTION OF FILM COMPRISING MICROFIBRILLATED CELLULOSE

This application is a U.S. National Phase under 35 U.S.C. § 371 of International Application No. PCT/IB2019/050768, filed Jan. 31, 2019, which claims priority under 35 U.S.C. §§ 119 and 365 to Swedish Application No. 1850123-9, filed Feb. 2, 2018.

TECHNICAL FIELD

The present invention is directed to a process for manufacturing a film comprising high amounts of microfibrillated cellulose (MFC), having haptic properties. According to the present invention, a wet web comprising MFC is formed, followed by addition of particles having an average diameter of at least 1 μm to the wet web, followed by dewatering and/or drying. The wet web may be formed for example by wet laid or cast forming methods. The particles may be added to the wet web for example by cast coating, curtain coating or spraying.

BACKGROUND

There is an increasing interest in being able to provide three dimensional structures on surfaces, such as surfaces of packaging materials, thin films, paper and paperboard. The three dimensional surface structures typically provide a haptic effect, i.e. the three dimensional structures provide a sensory sensation, for example such that a person touching the surface is able to notice that the surface has a three dimensional structure, i.e. a tactile effect. Depending on the specific structure concerned, the haptic effect influences the person's perception of the surface and its properties.

Films comprising high amounts of microfibrillated cellulose (MFC) are known in the art. Depending on how they are produced, the films may have particularly advantageous strength and/or barrier properties, whilst being biodegradable and renewable. Films comprising MFC are for example used in the manufacture of packaging materials and may be laminated or otherwise provided on the surface of paper or paperboard materials.

It is known that MFC films or webs comprising high amounts of MFC are difficult to dewater. Various chemical and mechanical solutions have been tested such as different retention chemicals, polymers, long fibers, different dewatering concepts etc. Typically, the cationic demand or charge of papermaking fiber suspensions in a wet end is very important for retention and dewatering. Charge regulation such as ionic or charge neutralization and/or polymer bridging assist in traditional fiber flocculation and dewatering and retention, respectively. The use of retention chemicals based on nanoparticles has been tested to some extent, particularly in conventional papermaking which hence aims towards charge and inter-particle control. Such retention concepts are efficient e.g. when running at higher machine speeds or if the suspension is hard to dewater.

However, to achieve a haptic effect on a surface or for a substrate, relatively large particles are usually required. Adding such particles to the wet end of a process for manufacture of thin substrates such as MFC films may negatively influence the strength and barrier properties of the film. The introduction of such foreign particle or components to a wet end may also alter the wet end chemistry, causing changes in the inter- and intra-particle interactions. Certain particles, especially large particles, are not colloidally stable and require a different stabilization method or mode of dosing in order to avoid sedimentation or clogging of e.g. nozzles or wire fabrics. It may also be advantageous, not only from a cost perspective, that the particles or components added to the substrate are in native form. Many of the particles with interesting haptic properties might further have complex chemistry, which causes unintentional or non-wanted or interfering interactions with or between the components in the furnish.

Traditionally, surface modification to provide a haptic experience of for example paper products is achieved by first manufacturing the paper and then modifying the surface of the dry paper in a separate process, such as by printing, which typically also requires additional chemicals such as a binder to ensure that particles are attached to the dry surface of the paper. Another solution is to add certain types of fibers to the wet end or then to use special additives in the mineral coating to provide haptic effects.

WO2014154937 A1 relates to a method for production of paper or board comprising providing a stock comprising cellulose fibers, adding a mixture comprising microfibrillated cellulose and a strength additive to the stock, adding a microparticle to the stock after the addition of said mixture, dewatering the stock on a wire to form a web, and drying the web.

US2003152724 relates to a coated paperboard having tactile properties, manufactured by printing texturized agents into the paper surface, followed by heating and curing.

There is a need for an efficient method for preparing films comprising a high amount of MFC, said films also providing a haptic experience, preferably with essentially maintained barrier and strength properties. Production efficiency in terms of runnability during the production of the film is important to be able to cost-effectively produce a film with adequate barrier and strength properties. It is desirable that the process is suitable for large-scale production and minimizes the need for additional chemicals to achieve the haptic effects. Additionally, it would be desirable if such a film comprising a high amount of MFC could be renewable (optionally biodegradable and/or compostable) and essentially free from plastic.

SUMMARY

It is an object of the present disclosure to provide an improved method of manufacturing a film comprising a high amount of microfibrillated cellulose (MFC), having haptic properties.

It has surprisingly been found that by using a process wherein a wet web comprising at least 50% by weight MFC is formed based on the dry content of the wet web (dry weight of MFC, dry weight of the web), followed by addition of particles having an average diameter of at least 1 μm to the wet web, followed by dewatering and/or drying, substrates or films having haptic properties but essentially maintained strength and barrier properties can be achieved. The wet web may be formed for example by wet laid or cast forming methods. The particles may be added to the wet web for example by cast coating, dripping, impregnation, curtain coating such as slot die, particle deposition, inkjet printing or spraying. The coating can be dry coating or wet coating or e.g. a film transfer coating process. The coating can also be carried out by an immersion process. The particles being added to the wet web may be added on one or both sides of the wet web.

By the process according to the present invention, a three dimensional haptic structure or texture can be achieved on the film, whilst still achieving the desirable barrier and strength properties. The three dimensional structure can for example be perceived as having a certain temperature, hardness, roughness, elasticity, stickiness, slipperiness or rubberiness.

In the context of the present application, the haptic effect or property may be related to a three dimensional structure or texture of the surface concerned. For example, the texture of the surface may be such that the surfaces feels soft or gives a feeling of friction. It may also be irregular and may even provide a pattern, or other means of communication with an individual with e.g. limited vision. To the extent a pattern is provided it may have a certain orientation but may alternatively be irregular. There can also be a functional effect associated with the haptic property, such as facilitating the handling of the object provided with the surface, for example by increased friction on its surface to facilitate gripping and holding the object. The haptic effect or property may also be a sensory effect perceivable through other, non-tactile sensory mechanisms, such as an optical effect that can be visually perceived. As a secondary effect, the steps taken to provide a haptic effect may also be provide a smell or scent, i.e. an olfactory form of perception or even flavour and/or taste. The haptic effect may also be a combination of effects, i.e. at least two sensory effects achieved simultaneously, such as a texture of a surface that is visible, i.e. provides an optical effect, and can also be noticed and sensed by touching the surface concerned, i.e. a tactile effect.

The strength (such as tensile strength) and/or barrier properties of the film comprising microfibrillated cellulose according to the present invention are essentially maintained, compared to a film comprising microfibrillated cellulose prepared without addition of particles to the wet web. Typically, the strength and/or barrier properties of a film according to the present invention is at least 50%, such as 60% or 70% or 80% or 90% of the the strength and barrier properties of a corresponding film prepared without addition of particles to the wet web.

The present invention is directed to a process for the production of an intermediate thin substrate or a film comprising the steps of:

a) providing a suspension comprising microfibrillated cellulose, wherein the content of the microfibrillated cellulose of said suspension is at least 50 weight-% based on the dry weight of solids of the suspension;
b) using the suspension of step a) to form a wet web;
c) adding particles having an average diameter of at least 1 μm to the wet web formed in step b);
d) dewatering and/or drying the web to form an intermediate thin substrate or film.

The wet web comprising MFC may be formed for example by wet laid or cast forming methods. For wet laid formation, the process may be carried out in a paper making machine. The said MFC web can be single or multilayer web.

The addition of particles to the wet web is preferably carried out on-line, i.e. the web is still a wet web and the step of adding particles is done in conjunction with the step of forming the web. Thus, the time elapsed between the forming of the web and the addition of the particles is typically less than 10 minutes, preferably less than 1 minute, more preferably less than 10 s.

The particles to be used in the process according to the present invention depend on the desired property of the film being produced. The particles may be organic or inorganic, hybrid (organic-inorganic), natural, synthetic and typically have low water solubility or different physical/chemical nature which make it difficult to form a stable and homogenous dispersion. When organic particles are used, they can for example be prepared from renewable materials, such as plants or wood, including forest or agricultural products or residues. The particles may for example be sawdust, dried and ground leaves, dried and ground bark or bark residues, dried and ground fruit bunches, needles, seeds, wood extracts, dried and ground agricultural residues, berries, fruit vegetables, straw, fibers, microfibrillated cellulose or carboxymethylcellulose provided in the form of particles, etc. The particles may also be recycled material and/or originate from broke or a waste stream, for example from a process for manufacturing paper or board.

If inorganic particles are used, they can be e.g. silica or modified silica or silicates, aluminium, talcum, or clays such as montmorillonite or bentonite, or various oxides or materials that imitate metallic effects like gold, silver, metal flakes, bronze etc.

The particles may also be metal, latex, glass, waxes, rubber or plastic particles, such as thermoplastic particles. The particles may be temperature sensitive and the physicochemical and/or mechanical properties of the particles may change dependent on the surrounding temperature.

The particles may be modified or surface treated to provide desirable surface properties or optical properties. The particles may also, in its native or in a modified form to achieve desirable surface properties and/or color. In addition, the film as such may be colored, i.e. may contain colorants, such as dyes or pigments.

The particles may incorporate a binder. Alternatively, a binder may be mixed with the particles and be added to the wet web together with the particles. Examples of binders include SB latex, starch, carboxymethylcellulose, polyvinyl alcohol acid etc. The binders can also be added in a separate coating step.

The particles may be provided in dry form, preferably having a moisture content of less than 20% by weight, preferably less than 10% by weight. The particles used according to the present invention have an individual average diameter of at least 1 μm, but may form clusters which are thus larger aggregates of particles. Preferably, the particles have an average diameter of at least 10 μm, more preferably at least 20 μm or at least 100 μm. The particles preferably have an average diameter less than 2 mm. The particles may be homogeneous and be of a defined size range, but may also be provided as a mixture of different types and/or sizes of particles.

The particles may be provided in the form of a suspension or dispersion when added to the wet web. The dry content of such a suspension or dispersion is typically 1-60 wt-%, preferably 3-40 wt-%, more preferably 5-30 wt-%. The liquid used in the suspension or dispersion may be aqueous or solvent based and may contain agents facilitating the formation of an even suspension or dispersion.

The amount of particles added to the wet web is preferably at least 1.0 kg/ton, such as 1.0-1000 kg/ton, 1.0-700 kg/ton, 1.5-500 kg/ton 1.5-400 kg/ton, 2-300 kg/ton or 4-300 kg/ton (on dry basis per ton of dry solids of the web).

The microfibrillated cellulose may have a Schopper Riegler value (SR°) of more than 60 SR°, or more than 65 SR°, or more than 80 SR°. The Schopper-Riegler value can be determined through the standard method defined in EN ISO 5267-1. The microfibrillated cellulose has a surface area of at least 30 $m^2/g$ or more preferably more than 60 $m^2/g$ or most pref. >90 $m^2/g$ when determined according to nitrogen adsorption (BET) method for a solvent exchanged and freeze dried sample.

The basis weight of the obtained film is preferably <100 $g/m^2$, more preferably <70 $g/m^2$ and most preferably <35 $g/m^2$.

After addition of the particles, a protective coating in the form of a binder or varnish may be applied. The protective coating can be applied to the wet web or after the dewatering and/or drying has started. Examples of binders include microfibrillated cellulose, SB latex, SA latex, PVAc latex, starch, carboxymethylcellulose, polyvinyl alcohol etc. The amount of binder used in a protective coating is typically 1-40 $g/m^2$, preferably 1-20 $g/m^2$ or 1-10 $g/m^2$. Such a protective coating may be provided using methods known in the art.

According to a further embodiment of the present invention, there is provided a laminate comprising a film prepared according to the present invention and a thermoplastic polymer (fossil based or made from renewable resources) coating, such as any one of a polyethylene, polyvinyl alcohol, EVOH, starch (including modified starches), cellulose derivative (Methyl cellulose, hydroxypropyl cellulose, carboxymethyl cellulose etc.), hemicellulose, protein, styrene/butadiene, styrene/acrylate, acryl/vinylacetate, polypropylene, a polyethylene terephthalate, polyethylene furanoate, PVDC, PCL, PHB, and polylactic acid. The coating can be provided e.g. by extrusion coating, film coating or dispersion coating. This laminate structure may provide for even more superior barrier properties and may be biodegradable and/or compostable. In one embodiment, the MFC film can be present between two coating layers, such as between two layers of polyethylene, with or without a tie layer. According to one embodiment of the present invention, the polyethylene may be any one of a high density polyethylene and a low density polyethylene or mixtures or modifications thereof that could readily be selected by a skilled person. According to further embodiment there is provided the film or the laminate according to present invention, wherein said film or said laminate is applied to the surface of any one of a paper product and a board. The film or laminate can also be part of a flexible packaging material, such as a free standing pouch or bag, which may be transparent or translucent. The product may also be for example a closure or lid. The product can be incorporated into any type of package, such as a box, bag, a wrapping film, cup, container, tray, bottle etc. The product may also be a label.

The intermediate thin substrate is an intermediate product which has not yet been processed into the final film having the characteristic OTR values, but may processed into such a film in a later converting process.

One embodiment of the present invention is a film produced according to the process of the present invention. The film is a thin sheet, mouldable film (such as for thermoforming, deep drawing, press forming) or web. It comprises a high amount of microfibrillated cellulose and can be laminated to form a multilayered structure. The film may be transparent or translucent. The OTR (oxygen transmission rate) value (measured at standard conditions) of the film is preferably <200 cc/m2*day measured at 50% RH, 23° C., preferably <30, more preferably <15 and most preferably <10 (i.e. before further treatment such as PE lamination) at a grammage of 10-50 gsm. The thickness of the film can be selected dependent on the required properties. Film thickness may for example be 10-100 μm, such as 20-50 or 30-40 μm, having a grammage of for example 10-50 gsm, such as 20-30 gsm. The film typically has good barrier properties (e.g. to gas, fat or grease, aroma, light etc.).

A further embodiment of the present invention is a product comprising the film produced according to the process of the present invention.

One embodiment of the present invention is a flexible package produced according to the process of the present invention. A further embodiment of the invention is a rigid package comprising a film produced according to the present invention.

DETAILED DESCRIPTION

The present invention is directed to the production of an intermediate thin substrate or a film comprising the steps of:

a) providing a suspension comprising microfibrillated cellulose, wherein the content of the microfibrillated cellulose of said suspension is at least 50 weight-% based on the dry weight of solids of the suspension;
b) using the suspension of step a) to form a wet web;
c) adding particles having an average diameter of at least 1 μm to the wet web formed in step b);
d) dewatering and/or drying the web to form an intermediate thin substrate or film.

The wet web can be prepared for example by wet laid and cast forming methods. In the wet laid method, the suspension is prepared and provided to a porous wire. The dewatering occurs through the wire fabric and optionally also in a subsequent press section. The final drying is usually done using convection (cylinder, metal belt) or irradiation drying (IR) or hot air. A typical wet laid is for example the fourdrinier former used in papermaking. In the cast forming method the wet web is formed for example on a polymer or metal belt and the subsequent initial dewatering is predominantly carried out in one direction, such as via evaporation using various known techniques.

In both techniques, it might be beneficial to prefer less contact drying in order to avoid destruction of the texture. Hence, the substrate should preferably be dried with non-impact drying methods such as infra-red (IR), ultraviolet (UV), electron beam (EB), hot air, hot steam etc. A soft nip dryer or contact dryers can be used depending on the type of deposited particles and texture formed or if a protective coating is used.

The addition of the particles takes place when the wet web has been formed. Thus, at the time of addition of the particles, the dry content of the web is 1-80% by weight, such as 1-60% by weight, such as 1-40% by weight, such as 3-20% by weight. The particles may be added to the full width of the wet web or to a part thereof. The particles can also be a mixture or added in several layers or in sequential steps.

The particles can be added in a defined pattern or randomly, depending on the desired haptic effect.

The microfibrillated cellulose content of the suspension is in the range of from 50 to 99.9 weight-% based on the weight of solids of the suspension. In one embodiment, the microfibrillated cellulose content of the suspension may be in the range of 70 to 99 weight-%, in the range of 70 to 95 weight-%, or in the range of from 75 to 90 weight-%.

Microfibrillated cellulose (MFC) shall in the context of the patent application mean a nano scale cellulose particle fiber or fibril with at least one dimension less than 100 nm. MFC comprises partly or totally fibrillated cellulose or lignocellulose fibers. The liberated fibrils have a diameter less than 100 nm, whereas the actual fibril diameter or particle size distribution and/or aspect ratio (length/width) depends on the source and the manufacturing methods.

The smallest fibril is called elementary fibril and has a diameter of approximately 2-4 nm (see e.g. *Chinga-Carrasco, G., Cellulose fibres, nanofibrils and microfibrils: The morphological sequence of MFC components from a plant physiology and fibre technology point of view, Nanoscale research letters* 2011, 6:417), while it is common that the aggregated form of the elementary fibrils, also defined as microfibril (Fengel, D., *Ultrastructural behavior of cell wall polysaccharides*, Tappi J., March 1970, Vol 53, No. 3.), is the main product that is obtained when making MFC e.g. by using an extended refining process or pressure-drop disintegration process. Depending on the source and the manufacturing process, the length of the fibrils can vary from around 1 to more than 10 micrometers. A coarse MFC grade might contain a substantial fraction of fibrillated fibers, i.e. protruding fibrils from the tracheid (cellulose fiber), and with a certain amount of fibrils liberated from the tracheid (cellulose fiber).

There are different acronyms for MFC such as cellulose microfibrils, fibrillated cellulose, nanofibrillated cellulose, fibril aggregates, nanoscale cellulose fibrils, cellulose nanofibers, cellulose nanofibrils, cellulose microfibers, cellulose fibrils, microfibrillar cellulose, microfibril aggregrates and cellulose microfibril aggregates. MFC can also be characterized by various physical or physical-chemical properties such as large surface area or its ability to form a gel-like material at low solids (1-5 wt %) when dispersed in water. The cellulose fiber is preferably fibrillated to such an extent that the microfibrillated cellulose has a surface area of at least 30 $m^2/g$ or more preferably more than 60 $m^2/g$ or most pref. >90 $m^2/g$ when determined according to nitrogen adsorption (BET) method for a solvent exchanged and freeze dried sample.

Various methods exist to make MFC, such as single or multiple pass refining, pre-hydrolysis followed by refining or high shear disintegration or liberation of fibrils. One or several pre-treatment step is usually required in order to make MFC manufacturing both energy efficient and sustainable. The cellulose fibers of the pulp to be supplied may thus be pre-treated enzymatically or chemically, for example to reduce the quantity of hemicellulose or lignin. The cellulose fibers may be chemically modified before fibrillation, wherein the cellulose molecules contain functional groups other (or more) than found in the original cellulose. Such groups include, among others, carboxymethyl (CM), aldehyde and/or carboxyl groups (cellulose obtained by N-oxyl mediated oxydation, for example "TEMPO"), or quaternary ammonium (cationic cellulose). After being modified or oxidized in one of the above-described methods, it is easier to disintegrate the fibers into MFC or nanofibrillar size fibrils.

The nanofibrillar cellulose may contain some hemicelluloses; the amount is dependent on the plant source. Mechanical disintegration of the pre-treated fibers, e.g. hydrolysed, pre-swelled, or oxidized cellulose raw material is carried out with suitable equipment such as a refiner, grinder, homogenizer, colloider, friction grinder, ultrasound sonicator, fluidizer such as microfluidizer, macrofluidizer or fluidizer-type homogenizer. Depending on the MFC manufacturing method, the product might also contain fines, or nanocrystalline cellulose or e.g. other chemicals present in wood fibers or in papermaking process. The product might also contain various amounts of micron size fiber particles that have not been efficiently fibrillated. MFC is produced from wood cellulose fibers, both from hardwood or softwood fibers. It can also be made from microbial sources, agricultural fibers such as wheat straw pulp, bamboo, bagasse, or other non-wood fiber sources. It is preferably made from pulp including pulp from virgin fiber, e.g. mechanical, chemical and/or thermomechanical pulps. It can also be made from broke or recycled paper.

The above described definition of MFC includes, but is not limited to, the new proposed TAPPI standard W13021 on cellulose nanofibril (CNF) defining a cellulose nanofiber material containing multiple elementary fibrils with both crystalline and amorphous regions.

According to another embodiment, the suspension may comprise a mixture of different types of fibers, such as microfibrillated cellulose, and an amount of other types of fiber, such as kraft fibers, fines, reinforcement fibers, synthetic fibers, dissolving pulp, TMP or CTMP, PGW, etc.

The suspension may also comprise other process or functional additives, such as fillers, pigments, wet strength chemicals, retention chemicals, cross-linkers, softeners or plasticizers, adhesion primers, wetting agents, biocides, optical dyes, fluorescent whitening agents, de-foaming chemicals, hydrophobizing chemicals such as AKD, ASA, waxes, resins etc.

The papermaking machine that may be used in the process according to the present invention may be any conventional type of machine known to the skilled person used for the production of paper, paperboard, tissue or similar products.

The dewatering of the wet web according to the wet web can be carried out using methods known in the art. For example, the wet web may be provided on a wire, and be dewatered to form an intermediate thin substrate or film.

The dewatering on wire may be performed by using known techniques with single wire or twin wire system, frictionless dewatering, membrane-assisted dewatering, infrared dewatering, vacuum- or ultrasound assisted dewatering, etc. After the wire section, the wet web may be further dewatered and dried by mechanical pressing including shoe press, hot air, radiation drying, convection drying, etc.

Optionally, wet pressing and/or contact drying can be used to remove moisture from the wet web.

Depending on the dryness of the wet web at the time of adding the particles and depending on the dewatering, the lateral and vertical distribution and infiltration of the particles within the film can be controlled. If the wet web has a high dry content, i.e. relatively low moisture content at the time of adding the particles and if dewatering is predominantly carried out in one direction, the particles will typically not be evenly distributed in the film. The particles will then mostly be present on the side of the film corresponding to the side of the wet web to which the particles were added in the process according to the present invention. Thus, in a cross section of the film, at least 70% of the particles may be present in one half of the cross section, corresponding to the side of the wet web to which the particles were added, and less than 30% of the particles may be present in the other half of the cross section. The distribution of particles may be evaluated by chemical analysis such as FTIR and/or RAMAN spectroscopy, coupled with elementary analysis and/or cross section imaging.

The film or the laminate may also be applied to other paper products, such as food containers, paper sheets, paper boards or boards or other structures that need to be protected by a barrier film.

The film obtained according to the present invention is typically such that it is possible to print on the film using printing methods known in the art.

Advantageously, the film obtained by the process according to the present invention retains its haptic properties when laminated or otherwise applied on other paper or board structures.

EXAMPLES

Films (30 gsm) prepared from MFC dispersion were prepared by vacuum filtration. Samples (see table 1) were added to the wet (5-6 wt-% dry content) or semi-wet (25-30 wt-% dry content) film in the final stage of the vacuum filtration. The samples were added by manually sprinkling onto the wet or semi-wet film. After sample addition, the wet or semi-wet films were dried in a drum drier at 80° C. for at least 90 minutes.

The resulting films were inspected visually before and after a taping test. The taping test was carried by attaching a tape (Scotch crystal) to the surface and subsequently detaching the tape. The films were characterized using a manual sensory analysis (table 1).

TABLE 1

| Samples, appearance | | |
|---|---|---|
| Sample | Estimated average particle size | Appearance |
| Barrisurf LX (kaolin), wet surface | <2 μm | Smooth, soft |
| Barrisurf LX (kaolin), semi-wet surface | <2 μm | Smooth, soft |
| Microtalc, semi-wet surface | About 1-8 μm | Smooth, slippery, soft, some material detaches |
| Arbocel CW 620, semi-wet | >8 μm (fiber diameter) <2000 μm (fiber length) | Powdery, soft, some material detaches |
| Actigum, semi-wet | >10 μm | Rough, granular, rough sand-paper |
| Micro-Technik CMC, DS = 0.26, semi-wet | 10-40 μm (fiber diameter) | Fine sand-paper, rough, hairy |
| Micro-Technik CMC, DS = 0.26, semi-wet, slower addition | 10-40 μm (fiber diameter) | Rough |
| Particles from Hansamix refined pine | Thickness 10-40 μm, length 0.1-4 mm | Rough, granular, some material detaches |

In view of the above detailed description of the present invention, other modifications and variations will become apparent to those skilled in the art. However, it should be apparent that such other modifications and variations may be effected without departing from the spirit and scope of the invention.

The invention claimed is:

1. A process for the production of an intermediate substrate or a film comprising the steps of:

a) providing a suspension comprising microfibrillated cellulose, wherein a content of the microfibrillated cellulose of said suspension is at least 50 weight-% based on a dry weight of solids of the suspension;

b) using the suspension of step a) to form a wet web;

c) adding particles having an average diameter of at least 1 μm to the wet web formed in step b);

d) dewatering the web, drying the web, or both dewatering and drying the web to form an intermediate substrate or film.

2. The process according to claim 1, wherein at least 50% by weight of the particles added are organic.

3. The process according to claim 1, wherein an amount of particles added to the wet web is at least 1 kg on dry basis per ton of dry solids of the web formed in step b).

4. The process according to claim 1, wherein the wet web is formed by cast forming.

5. The process according to claim 1, wherein the particles are added by curtain coating, cast forming, or spraying.

6. The process according to claim 1, wherein the particles have an average diameter of at least 10 μm.

7. The process according to claim 1, wherein the content of microfibrillated cellulose of the suspension in step a) is at least 60 weight-% based on the weight of solids of the suspension.

8. A film obtained according to the process of claim 1.

9. The film according to claim 8 having a haptic property.

10. The film according to claim 9 wherein the haptic property is texture, an optical effect, or both.

11. The film according to claim 10, wherein more than one sensory effect is achieved.

12. A product comprising a film according to claim 8.

* * * * *